US008372241B2

(12) United States Patent
Camus et al.

(10) Patent No.: US 8,372,241 B2
(45) Date of Patent: Feb. 12, 2013

(54) PROCESS FOR MANUFACTURING A SHEET MATERIAL

(75) Inventors: Michel Camus, Rives sur Fure (FR); Pierre Doublet, Saint-Brice (FR)

(73) Assignee: Arjowiggins Security, Paris (FR)

( * ) Notice: Subject to any disclaimer, the term of this patent is extended or adjusted under 35 U.S.C. 154(b) by 6 days.

(21) Appl. No.: 12/666,735

(22) PCT Filed: Jul. 11, 2008

(86) PCT No.: PCT/FR2008/051321

§ 371 (c)(1),
(2), (4) Date: Feb. 25, 2010

(87) PCT Pub. No.: WO2009/022072

PCT Pub. Date: Feb. 19, 2009

(65) Prior Publication Data

US 2010/0181036 A1 Jul. 22, 2010

(30) Foreign Application Priority Data

Jul. 11, 2007 (FR) ..... 07 56412

(51) Int. Cl.
*B44F 1/12* (2006.01)

(52) U.S. Cl. ..... 162/140

(58) Field of Classification Search ..... 162/140, 162/110, 123, 232, 267, 268, 103, 124; 283/94, 283/113

See application file for complete search history.

(56) References Cited

U.S. PATENT DOCUMENTS

| | | | | |
|---|---|---|---|---|
| 6,428,051 | B1 | 8/2002 | Herrmann et al. | |
| 6,616,803 | B1 | 9/2003 | Isherwood et al. | |
| 2003/0164611 | A1 * | 9/2003 | Schneider et al. | 283/57 |
| 2007/0128418 | A1 | 6/2007 | Rosset | |
| 2009/0001709 | A1 | 1/2009 | Kretschmar et al. | |

FOREIGN PATENT DOCUMENTS

| | | | |
|---|---|---|---|
| CN | 1635217 | A | 7/2005 |
| DE | 10 2005 045 566 | A1 | 9/2006 |
| EP | 0 059 056 | A1 | 9/1982 |
| EP | 0 229 645 | A1 | 7/1987 |

(Continued)

OTHER PUBLICATIONS

International Preliminary Report on Patentability issued in International Application No. PCT/FR2008/051321; Prepared Jan. 12, 2010.

(Continued)

*Primary Examiner* — Mark Halpern
(74) *Attorney, Agent, or Firm* — Oliff & Berridge, PLC

(57) ABSTRACT

A process for manufacturing a sheet material comprising at least two fibrous plies juxtaposed one on top of the other, including the following steps: a first paper ply is produced by filtration of an aqueous suspension of fibers on the wire cloth of a cylinder mold or of a former; a second paper ply is produced on the wire cloth of a second cylinder mold so as to form at least one recess in the second ply; at least one at least partially transparent element is placed between the two plies that are still wet; and the two plies are joined together so that said at least one recess of the second ply, the at least one at least partially transparent element and the at least one elongate region of zero thickness of the first ply are situated facing one another; then drying the obtained structure.

43 Claims, 3 Drawing Sheets

FOREIGN PATENT DOCUMENTS

Figure 1:
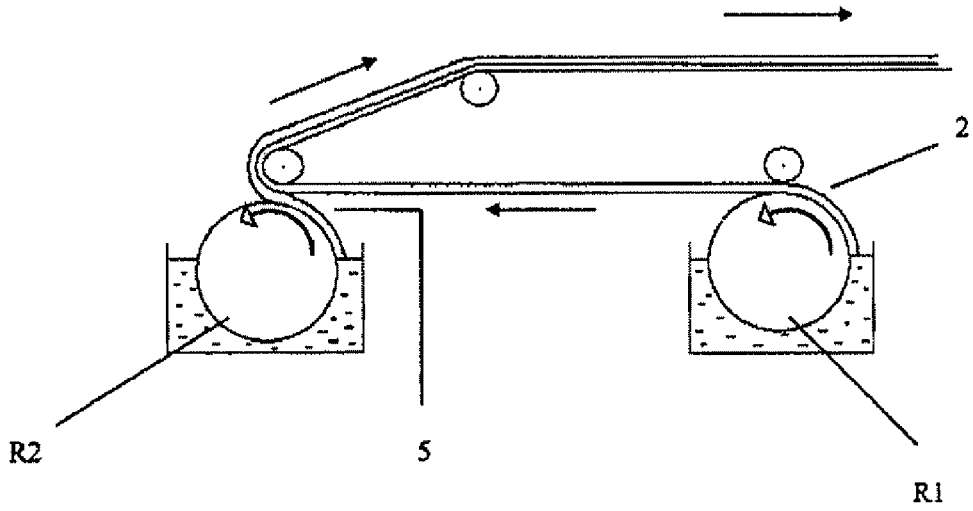

| | | | |
|---|---|---|---|
| EP | 0 625 431 | A1 | 11/1994 |
| EP | 0 825 297 | | 2/1998 |
| EP | 0 860 298 | A2 | 8/1998 |
| EP | 1 122 360 | A1 | 8/2001 |
| FR | 2 861 101 | A1 | 4/2005 |
| FR | 2 891 761 | A1 | 4/2007 |
| GB | 1 552 853 | | 9/1979 |
| WO | WO 94/20679 | A1 | 9/1994 |
| WO | WO 95/09274 | A1 | 4/1995 |
| WO | WO 00/39391 | A1 | 7/2000 |
| WO | WO 03/054297 | A2 | 7/2003 |
| WO | WO 2004/001130 | A1 | 12/2003 |
| WO | WO 2005/003458 | A1 | 1/2005 |
| WO | WO 2005/052249 | A1 | 6/2005 |
| WO | WO 2005/105472 | A2 | 11/2005 |
| WO | WO 2006/099971 | A2 | 9/2006 |

OTHER PUBLICATIONS

International Search Report issued in International Application No. PCT/FR2008/051321 on Feb. 12, 2009 (with translation).

Chinese Office Action issued in Application No. 200880024130.1; Dated May 19, 2011 (With Translation).

Jun. 14, 2012 Opponent's Brief in Opposition to EP 2 176 462 (with translation).

* cited by examiner

PROCESS FOR MANUFACTURING A SHEET MATERIAL

This application is a 371 of PCT/FR2008/051321 filed 11 Jul. 2008.

The present invention relates to a method for manufacturing a sheet material comprising at least one window, as well as a security document obtained by said method.

Various security sheets either provided with through-windows or not, notably allowing observation of a security article placed at the window, are known in the state of the art. Generally, these windows are apertures made in the security sheet and covered with a partly transparent security article such as a foil or a patch, which may contain a security article.

From patent GB 1,552,853, a banknote is known, comprising a paper layer inside which a security thread is incorporated. The paper layer includes windows facing each other showing the security thread. The windows may be made with a laser capable of removing material from the paper layer while leaving the security thread intact.

From patent application EP 229 645, a security paper is known comprising two paper plies between which a security thread is interposed. Holes are made on at least one of the paper plies with reliefs on the wire cloth for forming this paper ply.

From patent application EP 0 687 324, a method for manufacturing a banknote paper sheet is also known, including at least one region of reduced thickness relatively to the thickness of the remainder of the sheet. A practically transparent area is thereby obtained without having to pierce the paper in this area.

From application WO 95/09274, a security paper sheet is also known, consisting of two layers each including an area of zero thickness facing each other and a strip of transparent material enrobed in the sheet of paper, so that the transparent material strip is facing the areas of zero thickness. A transparent window is thereby obtained.

However, the thereby obtained sheets have the drawback of having on their faces differences in thickness, in particular over thicknesses at the inserted strip, so that, insofar that the areas of reduced or zero thickness have a large surface, the sheet becomes industrially difficult to handle. Indeed, in order to be able to store or transport the sheets, they are stacked in a large amount, so that the reduced thickness areas are led to be superposed, which leads to unbalance of the stack.

The application WO 2004/001130 describes a method for making a paper substrate consisting of bringing into contact with a wire cloth for forming the paper, a security thread, the wire cloth having reliefs allowing windows to be made on the substrate, though which an edge of the security thread is visible. This method is not suitable for incorporation in the paper substrate of a security thread having a relatively large width. Indeed, during the incorporation of a wide thread, visible defects such as an absence of material may appear at the surface of the paper layer.

From patent applications EP 0 860 298 and EP 0 625 431, a method is also known for manufacturing a security paper in which a security thread is incorporated inside a first paper layer according to the so-called <<window thread>> technique, described in patent application EP 0 059 056. This paper layer includes on one face a plurality of windows which show the security thread. In the case when the security thread has a relatively large width, notably greater than 2 mm, the first layer is then assembled with a second paper layer in order to hide the defect(s).

Moreover from U.S. Pat. No. 6,428,051, a security paper is known comprising a fibrous layer having a window covered by a foil, the window being made by embossing the fibrous layer. The dimensions and/or the shape of the window depend on the punching tool used, which requires changing tool if it is desired to form windows with different dimensions and/or shapes.

From application DE 10 2005 045 566 a method is known for manufacturing a sheet including two paper plies, one of which may have an elongate area of zero thickness in which a security element is placed and the other may have one or more recesses.

From application FR 2 891 761, a method is also known for manufacturing a sheet material including two paper layer having windows made by projecting at least one pressurized fluid jet after joining both paper plies.

Further from applications WO 00/39391 and WO 2005/0512249, methods are known for forming a paper sheet made of a single ply on a single round mould.

An object of the present invention is to provide a method with which a sheet material may be obtained with a window comprising a security element, preferably sufficiently wide and notably not having any notable overthickness.

Thus, the object of the invention is a method for manufacturing a sheet material including at least two fibrous plies juxtaposed on each other, the method including the following steps:

- making a first paper ply, including at least one elongate area of zero thickness, by filtration of an aqueous suspension of fibers on the wire cloth of a first round mould or of a former,
- making a second paper ply on the wire cloth of a second round mould, so as to form at least one recess in the second ply,
- positioning at least one at least partly transparent, component between both still moist plies and joining both plies so that said at least one recess of the second ply, said at least one at least partly transparent element and said at least one elongate area of zero thickness of the first ply are located facing each other,
- drying the thereby obtained structure.

Thus a sheet material is obtained, the structure of which includes in the region of superposition of the zero thickness elongate area including one at least partly transparent element of the first ply and one recess of the second ply, a transparent window.

An advantage of the invention is that by inserting one at least partly transparent elongate element, between both plies which are still moist during the manufacturing of the sheet material, the attachment of the at least partly transparent element with the sheet material is reinforced, and risks of delamination of the structure are strongly reduced. Further, the fact of inserting the at least partly transparent element during the forming of the sheet material and not after its manufacturing makes the reproduction of the sheet material particularly difficult, while reducing the manufacturing costs.

According to one embodiment of the invention, the fibers comprise cellulose fibers.

According to a preferred embodiment of the invention, the at least partly transparent element has a greater width than that of the zero thickness elongate area of the first ply, so that, upon inserting the at least partly transparent element within the sheet material, two edges of said at least partly transparent elongate element, are inserted between both fibrous plies. Preferably, the at least partly transparent elongate element has a width greater by 4 to 10 mm than that of the elongate zero thickness area in which it is positioned.

Each elongate zero thickness area of the first ply has a width preferably comprised between 5 and 50 mm, still preferably between 10 and 25 mm.

Each at least partly transparent element has a width preferably comprised between 9 and 60 mm, still preferably between 14 and 35 mm.

According to one embodiment of the invention, the at least partly transparent element has a thickness for example comprised between 10 and 50 μm. Advantageously, this element has the same thickness as that of the first ply, so that the outer surface of the first ply is quasi planar and does not have any notable overthickness. For example, the first ply of the sheet has a thickness of 20 μm, and a continuous strip of the same thickness is positioned in the zero thickness area of the first ply.

As compared with the mono-ply security sheets of the prior art, the method according to the invention has the advantage that, as the sheet material consists of several plies, the thickness of the first ply may be adapted to the thickness of the transparent element by which a planar sheet may thereby be obtained, regardless of the selection of the thickness of the transparent element.

According to a particularly advantageous embodiment of the invention, the at least partly transparent element comprises at least one securization means. In particular, the at least partly transparent element may comprise a device with a variable, interferential, in particular iridescent and/or diffractive optical effect, with liquid crystals, a system of lenses, a hologram, a magnetic, metal or crystalline coating, magnetic fibers, tracers which are detectable by magnetic resonance, tracers which are detectable by X fluorescence, biomarkers, a varnish or an ink, luminescent, in particular fluorescent, tracers, photochromic, thermochromic, electroluminescent and/or piezochromic and/or tribometric compounds, and/or compounds which change color upon contact with one or more predetermined products, or any other similar securization means.

According to a particular embodiment, at least one means for securizing the at least partly transparent element is exactly located facing a recess of the second jet. The security sheet is thereby obtained comprising at least one observable securization means at a window. It is also contemplated that the at least partly transparent element comprises several securization means, only some of which are located facing recesses of the second ply, and others which are not so.

In an example, the at least partly transparent element comprises at least one securization means located facing a recess of the second ply, and at the recess of the second ply, the total thickness of the at least partly transparent element is close to the thickness of the sheet material. For example, the at least partly transparent element has a thickness of 20 μm with overthicknesses of a thickness of 40 μm at the recesses of the second ply, in which a securization means may be placed.

An advantage of the security sheet according to the invention, is that with its structure it may include devices which are of a greater thickness than the foils generally used in transparent windows, such as chips or tactile devices. Indeed, the foils usually used have a thickness of the order of 5 to 10 μm, while chips or touch devices may have thicknesses from 30 to 90 μm.

According to one embodiment of the invention, the at least partly transparent element may for example be a patch, or preferably a continuous strip.

By "patch" is meant here a planar element having reduced dimensions, i.e. much smaller than those of the support on which it is affixed, notably with a square, round or oval shape. For example, the at least partly transparent element may appear as a patch having the shape of a square with a side of 1.5 cm.

Preferably, the at least partly transparent elongate element is a continuous strip and has the same length as the zero thickness elongate area of the first ply.

According to an embodiment of the invention, the support of the at least partly transparent element is in a synthetic material, for example a polyester film. Preferably, the zero thickness elongate area and the at least partly transparent element are of rectangular shape, have the same thickness and extend all along the first ply. For example, the at least partly transparent element is a continuous strip, the length of which corresponds to that of the zero thickness elongate area of the first ply and the width is 6 mm greater than that of the zero thickness elongate area, so that the zero thickness elongate area is entirely compensated by the continuous strip. In this way, a security sheet is advantageously obtained, the face of which corresponding to the first ply is planar. According to a preferred embodiment, the first ply includes several zero thickness elongate areas, parallel to each other and at least partly transparent elements located facing each zero thickness elongate area, in the whole surface of the first ply so that the first ply appears as a succession of fibrous strips and of at least partly transparent parallel strips.

According to another embodiment of the invention, the first ply further comprises at least one at least partial absence of material, located in at least one fibrous region. In this way, a first structured ply which is particularly difficult to imitate is obtained. Further, with such a structure it is possible by the presence of absences of material to obtain tactile effects allowing the material to be recognized upon touching it.

According to one embodiment, the absences of material are partial, i.e. that at these absences, the thickness of the first ply is reduced. If necessary, if the thickness of the first ply is sufficiently reduced at the absences of material, the absences allow observation of the second ply by transparency.

According to another embodiment, the absences of material are total i.e. that at these absences, the thickness of the first ply is zero. In this particular case the absences of material allow direct observation of the second ply.

According to an embodiment, the absences may extend over the whole width of the fiber region in which they are located.

In another embodiment, the absences of material do not extend over the whole width of the fibrous region in which they are located.

The absences may have different shapes, for example geometrical shapes such as a circular, triangular, square, rectangular shape or the like.

Preferably, and in order to ensure good strength and cohesion of the structure of the sheet material, the recess of the second ply has a width less than or equal to the width of the zero thickness elongate area of the first ply. Preferably the width of each recess of the second ply is at least 5 mm less than the width of the zero thickness elongate area of the first corresponding ply.

According to one embodiment of the invention, and in order to increase its securization level, the first and/or the second ply of the sheet material comprises at least one security element. Advantageously, the security elements are placed in the thickest ply, preferably the second ply. For example the first and/or second ply contains a watermark or a security thread.

In the embodiment where the fibrous regions of the first ply comprise absences, it is particularly advantageous that the second ply comprises security elements located facing these absences.

One of the advantages of the invention is that according to a particular embodiment, one of the plies may contain a wide security thread, i.e. for which the width is larger than 2 mm, notably comprised between 2 and 10 mm, preferably equal to about 3 mm, the incorporation area of this thread being covered by the other ply which thereby hides the defects that the thread has created.

The recesses of the second ply may have different geometrical shapes, for example a circular, rectangular, square, ovoid, triangular, hexagonal shape or the like. It may further be envisioned that the recesses have the shape of alphanumeric characters, of symbols.

In a particular embodiment, the second ply comprises several recesses arranged so as to form a code.

Depending on the subsequent envisioned use of the sheet material according to the invention, its total thickness may vary between 70 μm and 2 mm, preferably between 90 and 300 μm.

According to one embodiment of the invention, the first and second plies have equal thicknesses.

According to one embodiment of the invention, the first and second plies have different thicknesses. In particular, the second ply including the recesses has a thickness larger than 60 μm, in order avoid embrittlement of the second ply due to the presence of recesses, this ply should be relatively solid in order to support the first ply during the manufacturing of the sheet material. The first ply consisting of continuous paper strips may itself be thinner. For example, the sheet material has a total thickness of 110 μm, the first ply being 25 μm thick and the second ply being 85 μm thick.

According to a particular embodiment of the invention, the second ply of the sheet material comprises at least one watermark with a multitone effect located facing the at least partly transparent element appearing in a zero thickness elongate area of the first ply. Such a multitone watermark consists of pale areas, i.e. areas with a thickness less than the thickness of the remainder of the sheet, arranged so as to form the screened pattern. Such screened watermarks are described in patent application EP 1122360.

This embodiment is particularly advantageous since it allows an increase in the durability of a multitone effect watermark. Indeed, multitone effect water-marks are security elements which are very difficult to reproduce. However their making requires local reduction in the thickness of the paper sheet in a very significant way, which makes them sensitive to wear and generates the risk that the paper sheet becomes pierced with holes. This risk is all the more significant since the documents comprising security sheets, such as bank notes, must be very frequently handled. By placing the multitone effect watermark facing an at least partly transparent element appearing in a zero thickness elongate area of the first ply, the multitone effect watermark is protected and the risk of formation of holes is prevented.

According to a particular case of the invention, the zero thickness elongate area of the first ply is made by suppressing the filtration of the suspension over at least one area of the wire cloth of the first round mould or of the former.

According to a particular case of the invention, the suppression of the filtration on the first round mould and on the former is achieved by depositing masking areas on the perimeter of the first round mould or of the former. For example, these masking areas are made by means of masks in adhesive film, in metal, in adhesive or further in varnish.

According to another particular case of the invention, the wire cloth of the first round mould or of the former is further provided with parts preventing filtration of the suspension so as to form total absences of material in the fibrous material of the first ply.

According to another particular case of the invention, the wire cloth of the first round mould or of the former has embossments so as to form partial absences in the fibrous material of the first ply.

In both of these particular cases, a sheet material is thereby obtained having a first structured ply particularly difficult to reproduce.

According to another embodiment of the invention, the zero thickness elongate area of the first ply is made by removing material by means of a projection of a pressurized fluid jet, notably a water or air jet, on the still moist first ply, before assembling it with the second ply.

According to one embodiment, the recess of the second ply is made by embossing in relief the wire cloth of the second round mould, which prevents deposition of fibrous material at the embossments.

Obtaining recesses is also contemplated by attaching onto the wire cloth of the second round mould, parts preventing filtration, for example a metal part, notably an electrotype (i.e. a metal plate, generally in bronze), an adhesive part or a resin part. The shape of the part will thereby give the shape of the recess. The use of parts of different shapes is contemplated for making recesses with different shapes.

Finally, the recesses may be made by removing material by means of a projection of a pressurized fluid jet, notably a water-jet, on the second ply still humid, before its assembling with the first ply.

According to a preferred embodiment of the invention, the first round mould or the former, and the second round mould are synchronized so that said at least one recess of the second ply will be facing the zero thickness elongate area.

The invention also relates to a security document obtained according to the method described above. For example, the invention relates to a payment means such as a banknote or a cheque, an identity document such as an identity card, a driving license, a passport page or a visa, or a deed such as a property deed or a diploma, or any other paper-based document requiring securization, or further a securized package or a label.

According to a particular embodiment of the invention, the security document is such that the first ply comprises at least two security elements facing at least two recesses of the second ply, the two security elements being placed so as to be superposed when the security document if folded, in order to form additional securization or information. For example, a first security element may be a lenticular network which will cover a second security element formed by an invisible image, which will only be revealed upon superposing the two security elements. In another example, a first security element will be a polarized filter and a second security element will be liquid crystals, for example forming an image revealed by the filter.

The invention further relates to a sheet material including:

at least two fibrous plies juxtaposed on each other, a first paper ply, including at least one zero thickness elongate area, a second paper ply, at least one of the recess in the second ply, at least one at least partly transparent element between both plies, said at least one recess of the second jet, said at least one at least partly transparent element and said at least one zero thickness elongate area of the first ply being located facing each other.

The sheet material may have at least one of the characteristics defined earlier.

Figure 2:
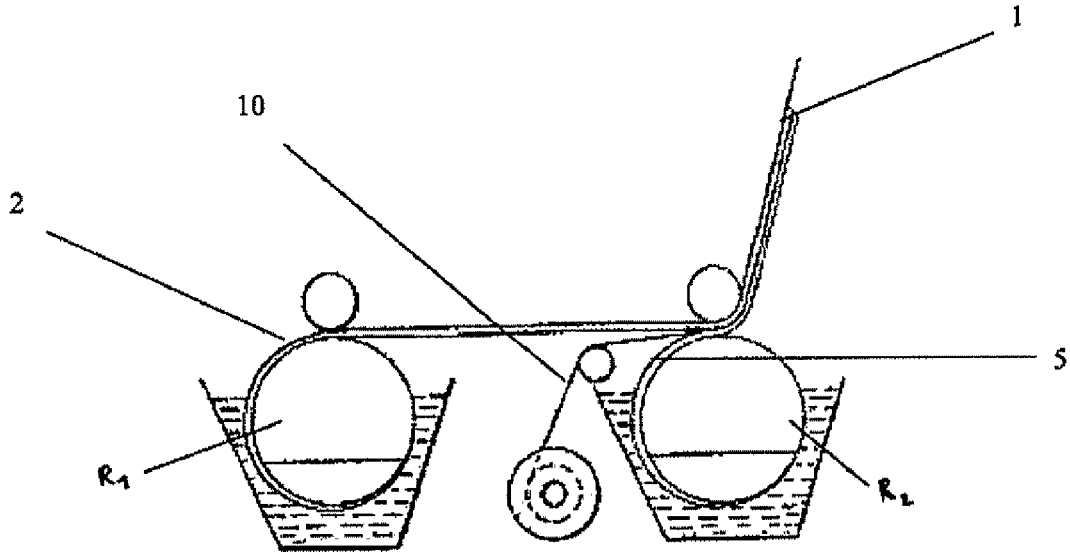
Figure 3:
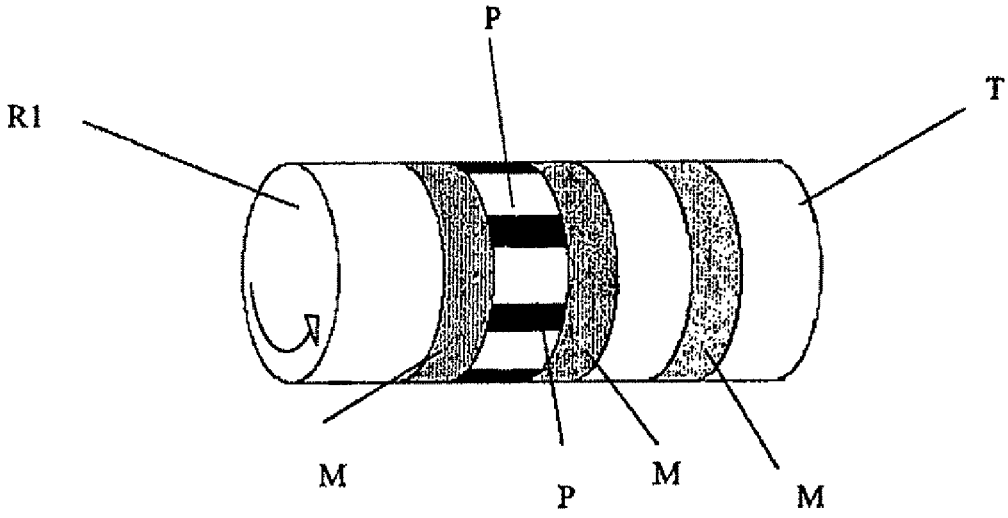
Figure 4:
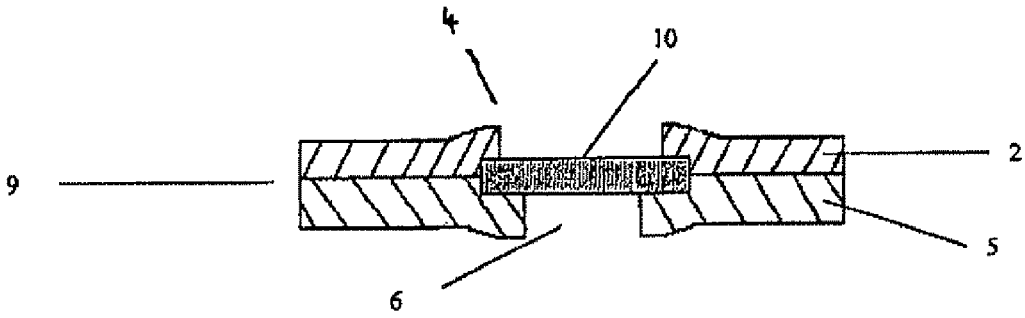
Figure 5:
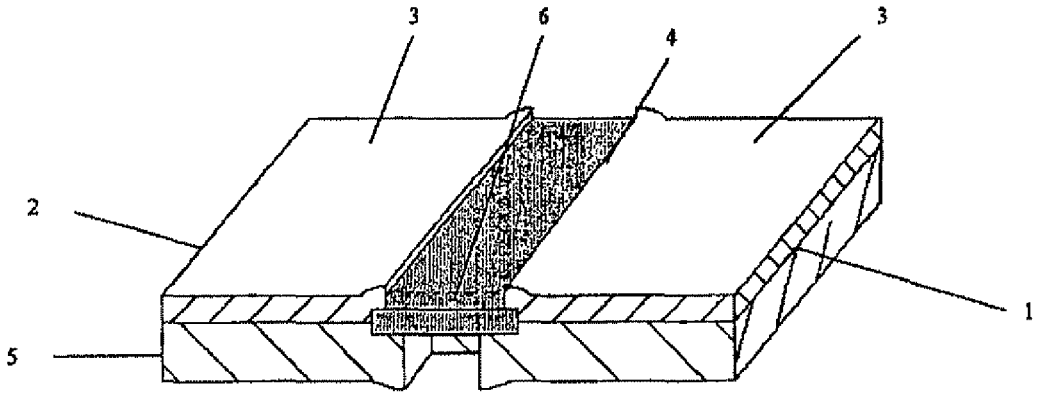
Figure 6:
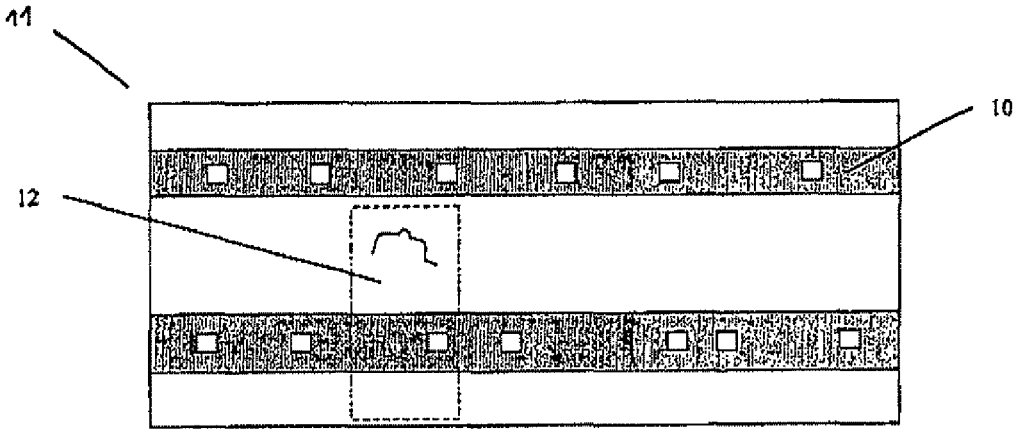

The invention may be better understood upon reading the following detailed description of non-limiting exemplary embodiments of the invention, and upon examining the appended drawing, wherein:

FIG. 1 is a diagram illustrating the different steps of the method according to the invention, FIG. 2 is a diagram illustrating a particular step of the method according to the invention, FIG. 3 is a diagram illustrating one of the round moulds used for making a sheet material according to an embodiment of the invention, FIG. 4 illustrates a transverse view of a sheet material obtained according to an embodiment of the invention, FIG. 5 illustrates a top view of the sheet material of FIG. 4, and FIG. 6 illustrates a top view of a banknote obtained by the method according to the invention.

For the sake of clarity, the relative proportions of the different illustrated elements have not always been observed, as the views are schematic and in FIGS. 4-6, only one zero thickness elongate area of the first ply of the sheet material is illustrated, surrounded by two areas in fibrous material.

FIG. 1 is a diagram illustrating the different steps of an embodiment of the manufacturing method according to the invention.

A first ply 2, having zero thickness elongate areas 4, is made from an aqueous suspension of cellulose fibers, by means of a first round mould R1 on the wire cloth on which masks M are deposited. In this way, the fibrous suspension only deposits in the regions without any masks M. At the same time, a continuous strip in transparent plastic 10 is inserted in the first ply at the masks M, this continuous strip being wider than the masks. A first moist ply 2 is thus obtained, consisting of an alternation of zero thickness elongate areas 4 in which transparent plastic strips and areas in fibrous material appear.

The thereby formed first ply 2 is brought towards a second round mould R2 so as to be deposited on the second fibrous ply 5 in formation. The second ply 5 is formed on the wire cloth of the second round mould, on which elements have been attached preventing the filtration of the suspension. The elements are placed in marked positions so that they form recesses 6 matching the positions of the zero thickness elongate areas 4 of the first ply 2. A second humid ply 5 is thereby obtained, consisting of fibrous material having recesses 6.

At the outlet of the second form, the first ply 2 is deposited on the second ply 5. A banknote sheet is obtained which may receive a surface or impregnation treatment e.g. for reinforcing the surface with PVA and/or for resistance to dirt or else further for improving printability, notably by means of size press or an impregnator. This sheet is then dried and wound according to usual procedures. FIG. 2 is a diagram illustrating a detail of a step of an embodiment of the method according to the invention, wherein the first fibrous ply 2 is formed on a machine with a round mould R1.

A continuous strip in transparent plastic material is brought into contact with the first fibrous ply being formed 2. The continuous strip 10 is placed in such a way that its centre is located at a mask M and its edges are in contact with the fibers which deposit on the depleted areas of the round mould R1.

FIG. 3 is a diagram illustrating the first round mould R1 used in a method for manufacturing a sheet material 1 according to the invention, in the particular case when the first fibrous ply 2 of said sheet material 1 includes zero thickness elongate areas 4 and fibrous regions comprising total absences of material.

The wire cloth T of the first round mould R1 includes rectangular masks in an adhesive film M, deposited so as to extend at regular intervals over the whole perimeter of the round mould R1. Thus, at the masks M, the suspension of fibers does not deposit, and the first fibrous ply 2 will have zero thickness areas 4. In the illustrated example, the first round mould R1 further includes rectangular parts in metal P deposited on the wire cloth T, between two adjacent masks M. These parts P prevent filtration of the fibrous suspension, therefore of any fibrous deposit, so that the fibrous regions 3 of the first ply (2) have total absences of material.

FIG. 4 and FIG. 5 illustrate a sheet material obtained according to an embodiment of the method of the invention; the overthicknesses at the zero thickness areas 4 have been voluntarily exaggerated.

The sheet material 1 consists of two plies of fibrous material. The first ply of fibrous material has an alternation of elongate areas in fibrous material 3 and zero thickness elongate areas 4. The second ply of fibrous material 5 has several rectangular and/or circular recesses 6 located facing a zero thickness elongate area 4 of the first ply 2. Between both jets 2 and 5 are positioned strips 10 in transparent plastic material, for example polyester, the edges of the strips being inserted into the elongate areas of fibrous material of the first ply 3 and of the second ply 5, and the centre of the strips 10 appearing inside the zero thickness elongate areas of the first ply 4.

In particular, in the case illustrated in FIGS. 4 and 5, the first and second plies have different thicknesses, the first ply 2 having a thickness of 40 μm and the second ply having a thickness of 70 μm. The second ply of fibrous material 5 has several circular recesses 6 located facing a zero thickness elongate area 4 of the first ply 2. Further, the transparent strip 10 has the same thickness as the zero thickness elongate area 4 into which it is inserted, so that the face of the sheet is quasi planar.

FIG. 6 illustrates a banknote 11 according to the invention which comprises the sheet material illustrated in FIGS. 4 and 5 and a watermark 12 made in the second ply 5.

Of course, the invention is not limited to the exemplary embodiments which have just been described. The characteristics of the various described examples may notably be combined within non-illustrated alternatives.

The expression <<including one>> should be understood as being synonymous with <<including at least one>>, unless specified otherwise.

The invention claimed is:

1. A method for manufacturing a sheet material including at least two fibrous plies juxtaposed on each other, said method comprising:

making a first paper ply, including at least one elongate area of zero thickness, by filtration of an aqueous suspension of fibers on a wire cloth of a first round mould or of a former, making a second paper ply on a wire cloth of a second round mould in order to form at least one recess in the second ply, and then positioning at least one at least partly transparent element between the first and second plies still moist so that edges of the at least partly transparent element are inserted between the first and second plies, and joining the first and second plies so that said at least one recess of the second ply, said at least one at least partly transparent element, and said at least one zero thickness elongate area of the first ply are located facing each other, drying the thereby obtained structure, said at least one at least partly transparent element being a continuous strip and having a same length as said at least one zero thickness elongate area of the first ply.

2. The method according to claim 1, wherein the fibers comprise cellulose fibers.

3. The method according to claim 2, wherein the first round mould or the former and the second round mould are synchronized so that said at least one recess of the second ply will be facing said at least one zero thickness elongate area.

4. The method according to claim 1, wherein said at least one at least partly transparent element has a larger width than a width of said at least zero thickness elongate area comprising it.

5. The method according to claim 1, wherein a width of said at least one zero thickness area of the first ply is comprised between 5 and 50 mm.

6. The method according to claim 5, wherein the width of said at least one zero thickness area of the first ply is comprised between 10 and 25 mm.

7. The method according to claim 1, wherein a width of said at least one at least partly transparent element is comprised between 9 and 60 mm.

8. The method according to claim 7, wherein a width of said at least one at least partly transparent element is comprised between 14 and 35 mm.

9. The method according to claim 1, wherein said at least one transparent element has a thickness larger than 10 μm.

10. The method according to claim 9, wherein said at least one transparent element has a thickness comprised between 10 and 50 μm.

11. The method according to claim 1, wherein said at least one at least partly transparent element has a same thickness as said first ply.

12. The method according to claim 1, wherein said at least one at least partly transparent element includes at least one securization means.

13. The method according to claim 12, wherein said securization means is selected from a device with a variable, interferential, iridescent and/or diffractive, optical effect, with liquid crystals, a lens system, a hologram, a magnetic, metal or crystalline coating, magnetic fibers, tracers detectable by magnetic resonance, tracers detectable by X fluorescence, biomarkers, a varnish or an ink, luminescent tracers, fluorescent tracers, photochromic, thermochromic, electroluminescent and/or piezochromic and/or tribometric compounds and/or compounds which change color upon contact with one or more predetermined products.

14. The method according to claim 12, wherein said securization means is a chip.

15. The method according to claim 12, wherein said securization means is exactly laid out facing said at least one recess of the second ply.

16. The method according to claim 15, wherein at said at least one recess of the second ply, said at least one at least partly transparent element including said securization means has a thickness close to that of thea remainder of the sheet material.

17. The method according to claim 1, wherein said at least one at least partly transparent element is a continuous strip.

18. The method according to claim 1, wherein said at least one at least partly transparent element is a patch.

19. The method according to claim 1, wherein said at least one partly transparent element has a plastic support.

20. The method according to claim 1, wherein said first ply further comprises at least one at least partial absence of material in at least one region of non-zero thickness.

21. The method according to claim 20, wherein said at least one absence extends over a whole width of the non-zero thickness region comprising it.

22. The method according to claim 1, wherein said at least one recess of the second ply has a width less than or equal to a width of said at least one zero thickness elongate area of said first ply facing said at least one recess.

23. The method according to claim 22, wherein the width of said at least one recess of the second ply is at least 5 mm less than the width of said at least one zero thickness elongate area of the first ply placed facing said at least one recess.

24. The method according to claim 1, wherein said first ply and/or said second ply comprises a security element.

25. The method according to claim 24, wherein said security element is a watermark or a security thread.

26. The method according to claim 24, wherein said security element is a wide thread with a width larger than 2 mm, included in one of the first and second plies and covered by a material of the other ply.

27. The method according to claim 1, wherein said at least one recess of the second ply has a geometrical shape of an alphanumerical character, of a symbol or of a drawing.

28. The method according to claim 1, wherein said second ply of the sheet material comprises at least one multitone effect watermark facing an at least partly transparent element of a zero thickness elongate area of the first ply of said sheet material.

29. The method according to claim 1, wherein said at least one zero thickness elongate area of the first ply is made by suppressing filtration over at least one area of the wire cloth of the first round mould or of the former.

30. The method according to claim 29, wherein suppression of the filtration on the first round mould or on the former is achieved by depositing masking areas on a perimeter of said first round mould or said former.

31. The method according to claim 30, wherein said mask is made in an adhesive film, in metal, in an adhesive or in a varnish.

32. The method according to claim 1, wherein said at least one zero thickness elongate area of the first ply is made by removing material with a projection of pressurized fluid jet, before assembling it with the second ply.

33. The method according to claim 32, wherein said pressurized fluid jet is a water jet.

34. The method according to claim 32, wherein said pressurized fluid jet is an air jet.

35. The method according to claim 1, wherein said wire cloth of the first mould or of the former comprises parts preventing the filtration of the suspension so as to a total absence of material in a fibrous material of said first ply.

36. The method according to claim 1, wherein said wire cloth of the first mould or of the former comprises embossments so as to form a partial absence of material in a fibrous material of said first ply.

37. The method according to claim 1, wherein said at least one recess on the second ply is made by embossing the wire cloth of the second round mould.

38. The method according to claim 1, wherein said at least one recess on the second ply is obtained by attaching, on the wire cloth of the second round mould, parts preventing the filtration.

39. The method according to claim 38, wherein said part preventing filtration is a metal part, an adhesive part or a resin part.

40. The method according to claim 1, wherein said at least one recess on the second ply is obtained by removing material with a projection of a pressurized fluid jet on the still moist second ply, before assembling it with the first ply.

41. A security document, comprising a sheet material obtained according to claim 2.

42. The security document according to claim 41, wherein said first ply comprises at least two security elements facing at least two recesses of the second ply, said two security elements being placed so as to be superposed when the security document is folded in order to form additional securization or information.

43. A sheet material including:

at least two fibrous plies juxtaposed on each other, a first paper ply, including at least one elongate area of zero thickness, a second paper ply, at least one recess in the second ply, at least one at least partly transparent element between both the first and second plies, said at least one recess of the second ply, said at least one at least partly transparent element and said at least one zero thickness elongate area of the first ply being located facing each other, said at least one at least partly transparent element being a continuous strip and having a same length as said at least one zero thickness elongate area of the first ply, wherein edges of the at least partly transparent element are inserted between the first and second plies.

* * * * *